United States Patent [19]

Baselice et al.

[11] 4,192,496

[45] Mar. 11, 1980

[54] APPARATUS FOR FEEDING CASE BLANK SHEETS

[75] Inventors: Louis R. Baselice, Cliffside Park; Anthony Freakes, Leonia; Joseph A. Miller, Englewood; George A. Ventz, Clifton, all of N.J.

[73] Assignee: General Corrugated Machinery Co., Inc., Palisades Park, N.J.

[21] Appl. No.: 885,040

[22] Filed: Mar. 9, 1978

[51] Int. Cl.[2] ..... B65H 3/04; B65H 1/26; B65H 3/54

[52] U.S. Cl. ..... 271/10; 271/35; 271/165; 271/167; 271/275; 198/485; 414/130

[58] Field of Search ..... 271/3.1, 35, 157, 165, 271/166, 131, 10, 275, 167, 137, 124, 104, 198; 214/8.5 A, 8.5 G, 6 D, 1 S, 6 TS, 8.5 R; 198/485, 817; 193/35 R; 414/32, 112, 113, 125, 130

[56] References Cited

U.S. PATENT DOCUMENTS

| | | | |
|---|---|---|---|
| 1,808,142 | 6/1931 | LaBombarde | 271/240 |
| 3,522,943 | 8/1970 | Swanson | 271/3.1 X |
| 3,528,576 | 9/1970 | Runyan et al. | 271/35 X |
| 3,871,642 | 3/1975 | Mariaux et al. | 271/167 X |
| 3,880,419 | 4/1975 | Swanson | 271/3.1 |
| 4,047,625 | 9/1977 | Grant | 198/485 X |
| 4,062,532 | 12/1977 | Peter et al. | 271/3.1 X |

FOREIGN PATENT DOCUMENTS

| | | | |
|---|---|---|---|
| 6616059 | 6/1967 | Netherlands | 271/35 |

*Primary Examiner*—Bruce H. Stoner, Jr.
*Attorney, Agent, or Firm*—Samuelson & Jacob

[57] ABSTRACT

Apparatus for receiving a stack of case blank sheets from a source of supply and delivering the sheets in shingled arrangement, for further processing, by receiving the stack at a first level, elevating the stack intact vertically to a second level above the first level, where the stack is transferred to a feeder located at the second level for operation in association with a stripper to feed the sheets forward in shingled arrangement from the bottom of the stack, while stabilizing the stack against toppling backward during feeding of the sheets forward from the bottom of the stack.

14 Claims, 16 Drawing Figures

APPARATUS FOR FEEDING CASE BLANK SHEETS

The present invention relates generally to case blank sheet feeding and pertains, more specifically, to apparatus and method for accepting a stack of corrugated paper board case blank sheets from a source, such as a corrugator, or from storage, and delivering the sheets of the stack in shingled arrangement for further processing, such as in a printer or a like finishing machine.

In the manufacture of corrugated paper cases or boxes, case blank sheets are first fabricated in a machine known as a corrugator, and are then delivered to further machinery which will perform additional operations, such as placing printed matter on the face of each case blank sheet. As production rates are increased, it becomes advantageous to employ apparatus for automatically delivering the case blank sheets from one machine to another as the cases or boxes are manufactured.

Because the rate at which the corrugator can manufacture case blank sheets is greater than the rate at which the printer can print the sheets, or the rate at which other machinery can perform further operations, and since the output of the corrugator is in the form of sheets of different widths, the output of the corrugator is accumulated in upright stacks of sheets and the sheets are then delivered from such stacks to the hopper of the printer or further machine. It has been found that delivery of the sheets in a stream of sheets in shingled arrangement is most desirable from the standpoint of uniformity and control of the feed of sheets from the upright stacks to the hopper of the further machine.

It is an object of the present invention to provide improved apparatus and method for receiving upright stacks of case blank sheets and delivering the sheets in shingled arrangement to the input of a machine for processing the sheets further.

Another object of the invention is to provide apparatus and method in which an upright stack of case blank sheets is received and then elevated intact to enable feeding of the sheets from the bottom of the upright stack, thereby enabling a compact arrangement which utilizes a minimum of floor space.

Still another object of the invention is to provide apparatus and method which will accept case blank sheets in upright stacks and will deliver the sheets in shingled arrangement with increased reliability and control.

Another object of the invention is to provide apparatus and method for receiving case blank sheets in upright stacks and delivering the sheets in a shingled stream by feeding sheets from the bottom of the stack in a forward direction while stabilizing the stack against toppling in a backward direction.

A further object of the invention is to provide apparatus for receiving case blank sheets in upright stacks and for delivering the sheets in shingled arrangement from the bottom of the stack, the apparatus including warp-compensating means for facilitating the advancement of warped sheets in the stack.

A still further object of the invention is to provide apparatus for receiving case blank sheets in upright stacks and for delivering the sheets in shingled arrangement, the apparatus being not only compact, but simplified in design and construction for economy and for reliable operation.

The above objects, as well as still further objects and advantages, are attained by the present invention which may be described briefly as apparatus and method for receiving a stack of case blank sheets from a source of supply and delivering the sheets in a forward direction from the bottom of the stack, in shingled arrangement, for further processing, the method and apparatus comprising, respectively, the steps of and means for receiving the stack of sheets from the source, the stack being received at a first level, raising the stack intact to a second level, feeding the sheets in a shingled stream in the forward direction from the bottom of the stack of sheets, and stabilizing the stack of sheets against toppling in a backward direction during feeding of the sheets from the bottom of the stack.

The invention will be more fully understood, while still further objects and advantages will become apparent, in the following detailed description of an embodiment of the invention illustrated in the accompanying drawing, in which.

Figure 1:
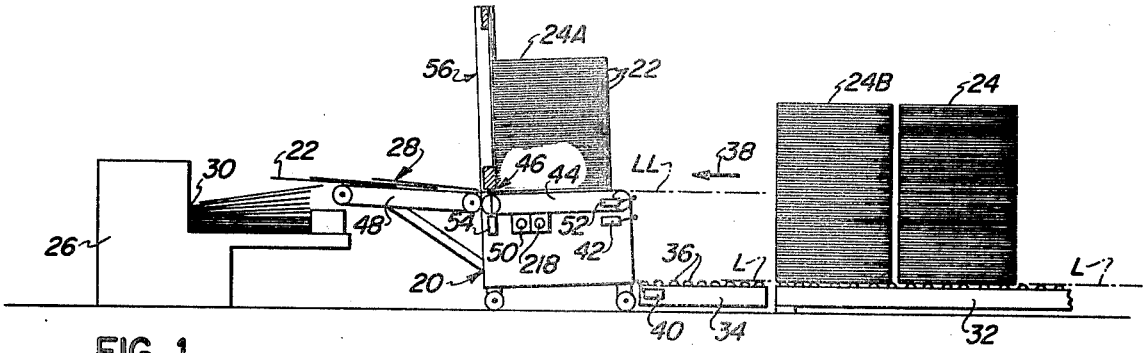
FIGS. 1 through 5 are diagrammatic, elevational views showing the progression of case blank sheets through apparatus constructed in accordance with the invention and illustrating a method of the invention.
Figure 2:
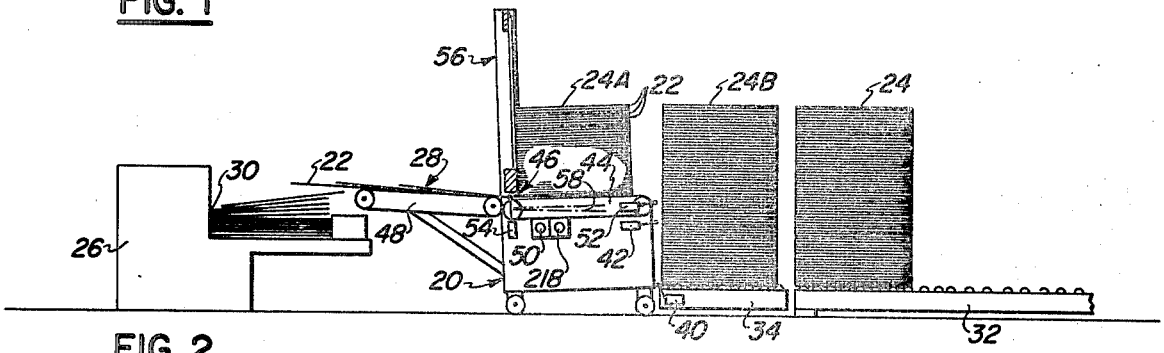

Referring now to the drawing, and especially to FIGS. 1 through 5 thereof, the operation of an apparatus constructed in accordance with the invention and the method of the invention are illustrated in diagrammatic fashion in connection with machine 20. Machine 20 is intended to receive case blank sheets 22 in upright stacks 24 from a source of supply and deliver the sheets 22, in a shingled stream, for further processing, as, for example, in a printer 26. In FIG. 1, machine 20 is shown with a first stack 24A already in place in the machine and a stream 28 of shingled sheets 22 being delivered to the hopper 30 of the printer 26. Subsequent stacks 24 have been brought to the machine 20 along a supply conveyor 32 which does not form a part of the invention, but which merely facilitates the movement of stacks 24 to machine 20 from a source of supply located off to the right of the drawing. The source of supply may be a corrugator, or a like machine, or a storage area where stacks 24 are held pending delivery for further processing.

As sheets 22 are being advanced from stack 24A in machine 20, the next subsequent stack 24B is moved, either manually or otherwise, onto a receiving means shown in the form of a platform 34 which is a part of machine 20, and is located at a first level L. Rollers 36 are provided on platform 34 to facilitate advancement of the stack 24B in the forward direction, indicated by arrow 38, until stack 24B reaches the position illustrated in FIG. 2. At that position, stack 24B actuates a limit switch 40 which operates a lift or elevator means to raise platform 34, with stack 24B intact, in a vertical direction, generally perpendicular to the forward direction, toward a second level LL above first level L.

Figure 3:
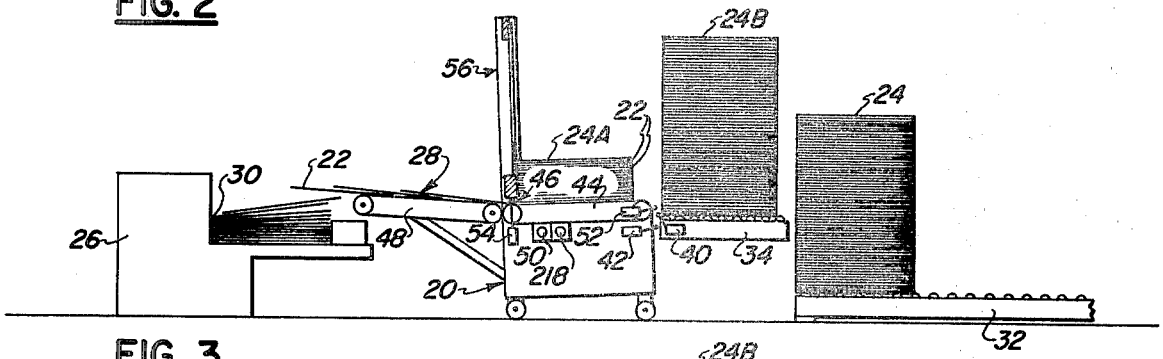

Upon reaching an intermediate level, between first level L and second level LL, as illustrated in FIG. 3, platform 34 actuates a limit switch 42 which stops the elevator means and causes the platform to dwell at the intermediate level. While at the intermediate level, the stack 24B is accessible to an operator who may manipulate the stack manually to assure that the stack is in the optimum orientation and position relative to the machine 20. While the platform 34 dwells at the intermediate position with stack 24B, sheets 22 continue to be fed from the bottom of stack 24A by feed means shown in the form of a feed conveyor 44. Feed conveyor 44 advances the lowermost sheets 22 of stack 24A beneath stripper means in the form of a gate 46 which controls the feeding of the sheets to establish the shingled stream 28 which continues along a delivery conveyor 48 of the feed means to the hopper 30 of printer 26, all as will be described in greater detail hereinafter.

Figure 4:
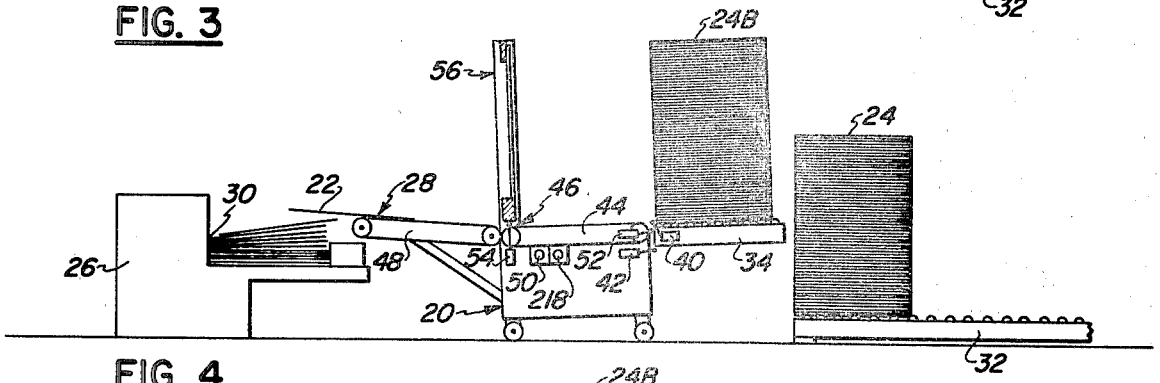
Figure 5:
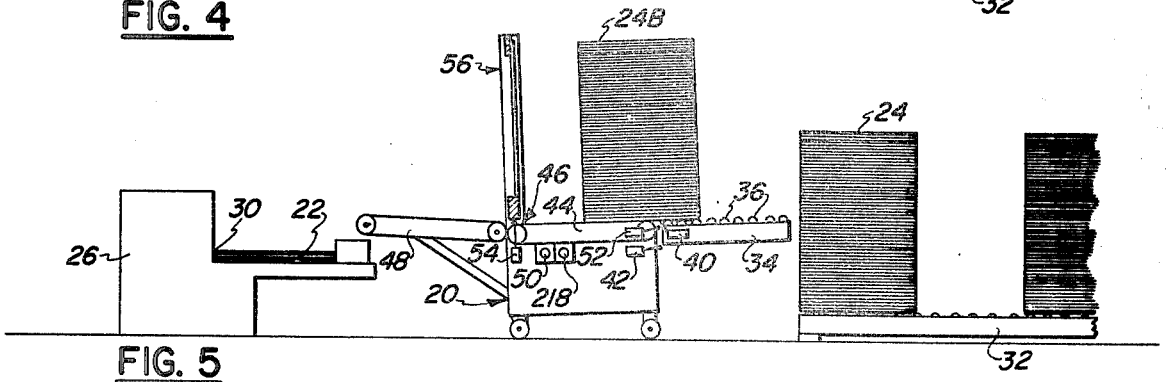

When stack 24A is exhausted and the last sheet 22L passes beyond gate 46, as seen in FIG. 4, the operator observes the condition and actuates a push-button switch 50 which overrides limit switch 42 to discontinue the dwell at the intermediate position, and the elevator means is again activated to raise the platform 34 to the upper, second level LL. A transfer means then causes the platform 34 to tilt forward, as seen in FIG. 5, so that stack 24B will be biased, by the force of gravity, toward feed conveyor 44. At the same time, a limit switch 52 is actuated to stop the elevator means.

Returning for a moment to the condition illustrated in FIG. 4, when the last sheet 22L passed beyond the gate 46, the absence of sheets 22 at gate 46 was sensed by a sheet sensing switch 54 located at the gate. In response to the absence of sheets at the gate, switch 54 caused the feed conveyor 44 to shift to a lower speed than the previous relatively higher speed at which rate the sheets 22 were fed beneath the gate 46. Thus, upon transfer of the stack 24B from platform 34 to feed conveyor 44, the lower speed of feed conveyor 44 will assure that stack 24B will not topple backwards when accelerated in the forward direction by engaging the feed conveyor 44.

Once the stack 24B reaches the feed location at gate 46, the presence of sheets 22 of stack 24B at the feed location will be detected by sheet sensing switch 54 and, in response to switch 54 detecting that condition, feed conveyor 44 will resume the higher speed for feeding sheets 22 beneath gate 46. At the same time, in response to operation of switch 54, the elevator means will be actuated to lower the platform 34 to the first level L and the condition illustrated in FIG. 1 is repeated. Any tendency for the stack to topple backwards as the sheets are being fed from the bottom of the stack is defeated by stabilizing means which includes a stop assembly 56 juxtaposed with the gate 46 and an angle 58 which places the feed conveyor 44 at a tilt toward the gate 46 to bias the stack against the stop assembly 56, thereby precluding backward toppling of the stack.

Figure 6:
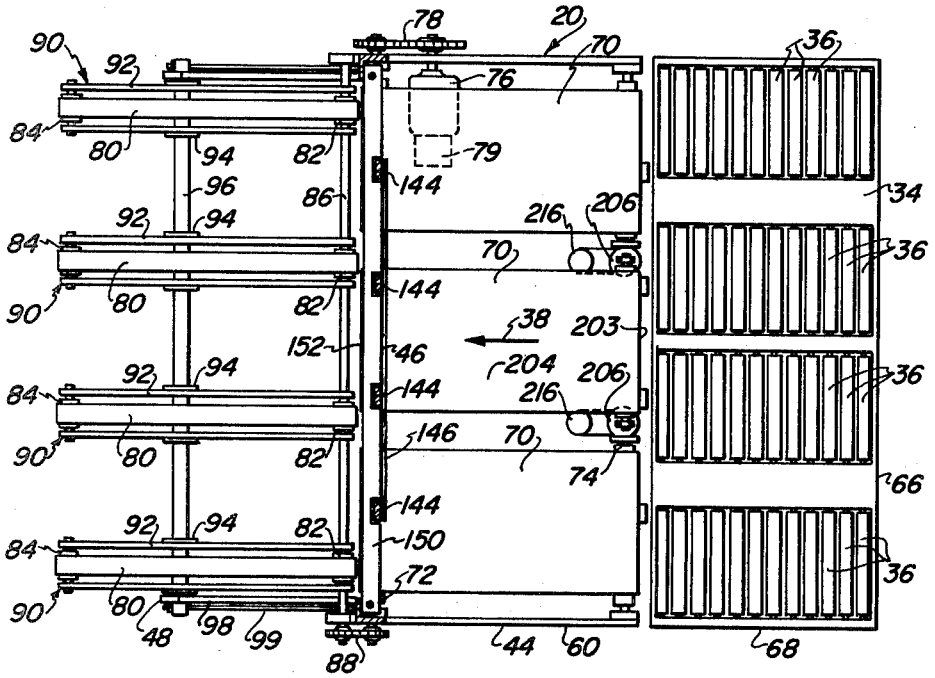
FIG. 6 is a top plan view of the apparatus.
Figure 7:
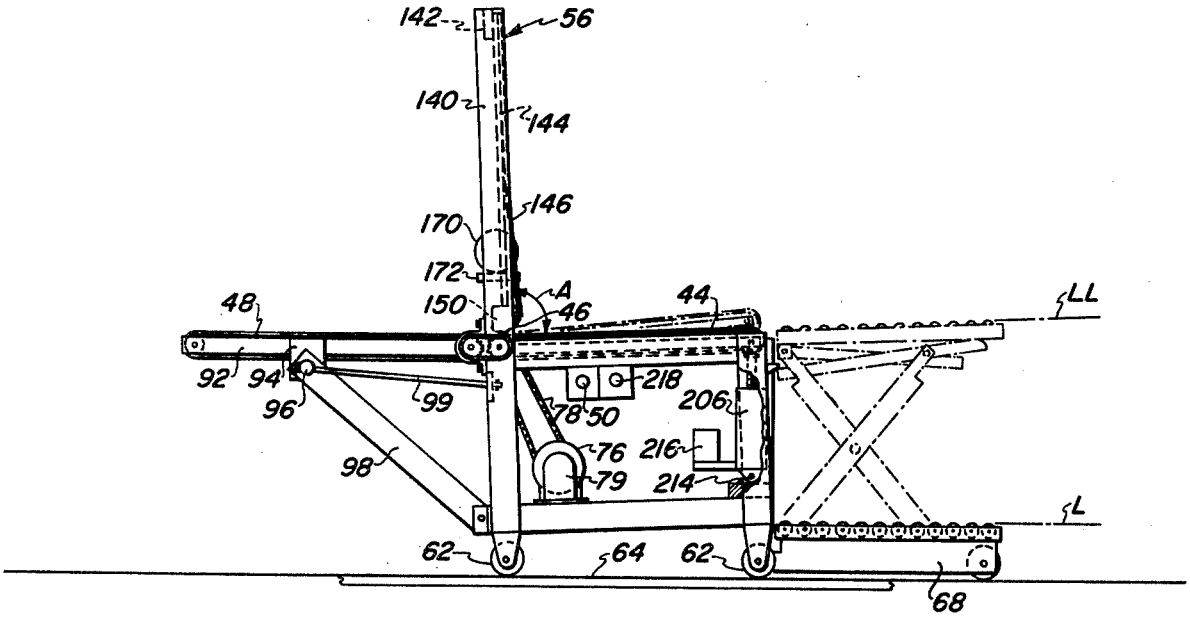
FIG. 7 is a side elevational view of the apparatus.

Turning now to FIGS. 6 and 7, as well as to FIGS. 1 through 5, machine 20 is seen to have a main frame 60 supported upon wheels 62 which may be guided by tracks 64 to enable forward and backward movement of the machine 20 to locate the machine accurately relative to associated machines and equipment, to adjust the location for accommodating various size sheets and for providing access to the associated machines. At the input end 66 of the machine 20, platform 34 is supported by a sub-frame 68 and rollers 36 are journalled for rotation on platform 34 in rows running parallel to the direction of movement of the stacks to establish an input roller conveyor for each stack brought into the machine.

The feed conveyor 44 includes a plurality of relatively wide conveyor belts 70 extending longitudinally between a drive roll 72 and individual idler rolls 74. A drive means in the form of a drive motor 76 coupled to the drive roll 72 through a drive chain 78 operates to move the conveyor belts 70 in the forward direction to advance stacks 24 of sheets 22 and to feed the sheets 22 as aforesaid. A speed control 79 operates in response to sheet sensing switch 54 to control the speed of drive motor 76 and effect the higher and lower conveyor speeds described above in connection with FIGS. 1 through 5. Belts 70 are relatively wide in order to provide a large surface area for contacting the lowermost sheet of a stack and gripping that sheet with frictional forces of sufficient magnitude to enable feeding of the sheets from the bottom of the stack.

The delivery conveyor 48 includes a plurality of narrower conveyor belts 80 each extending longitudinally between a drive roll 82 and an idler roll 84. Drive rolls 82 are engaged by a common drive shaft 86 which is coupled by a drive chain 88 to drive roll 72 for movement of the conveyor belts 80 in the same direction and in synchronism with conveyor belts 70. Each conveyor belt assembly 90 of the delivery conveyor 48 includes a sub-frame 92 which carries the drive roll 82 and the idler roll 84. The sub-frames 92 include depending brackets 94 which rest upon a crossbar 96 supported upon main frame 60 by support arms 98 and supplementary braces 99. The sub-frames 92 and the drive rolls 82 carried thereby are slidable along the drive shaft 86 for selective placement in any lateral position relative to one another so that the conveyor belt assemblies 90 may be relocated selectively for various widths of sheets to be conveyed thereby. The relatively narrow conveyor belts 80 enable ready access by an operator to the sheets passing along the further conveyor so that manual adjustments are available to correct skewing or clumping in the advancing sheets.

By terminating the feed conveyor 44 at the gate 46 and utilizing a separate delivery conveyor 48 beyond the gate 46, each conveyor 44 and 48 may be constructed for optimum characteristics. Thus, the relatively wide conveyor belts 70 of feed conveyor 44 are best suited to provide the frictional forces needed to feed sheets 22 from the bottom of a stack 24, while the narrower conveyor belts 80 of the delivery conveyor 48 are best suited to provide the appropriate operator access to the shingled stream 28 and the necessary adjustments for sheet width.

Figure 8:
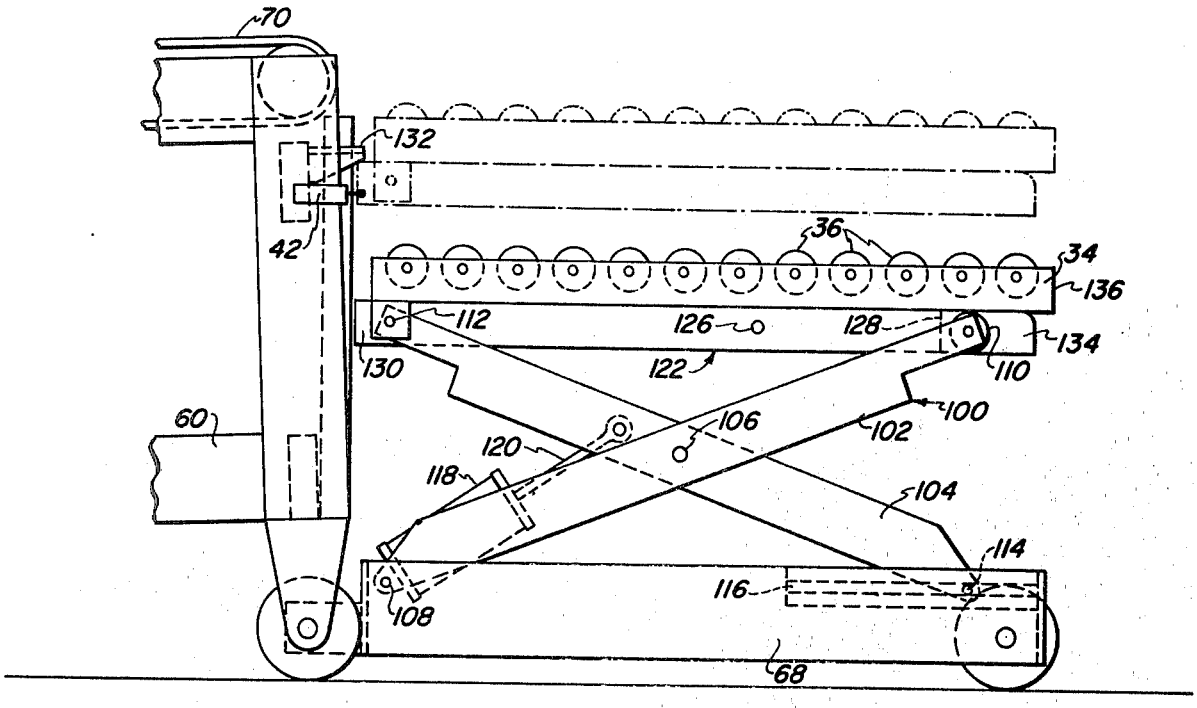
FIG. 8 is an enlarged fragmentary side elevational view of a portion of the apparatus showing component parts in a particular operating position.
Figure 9:
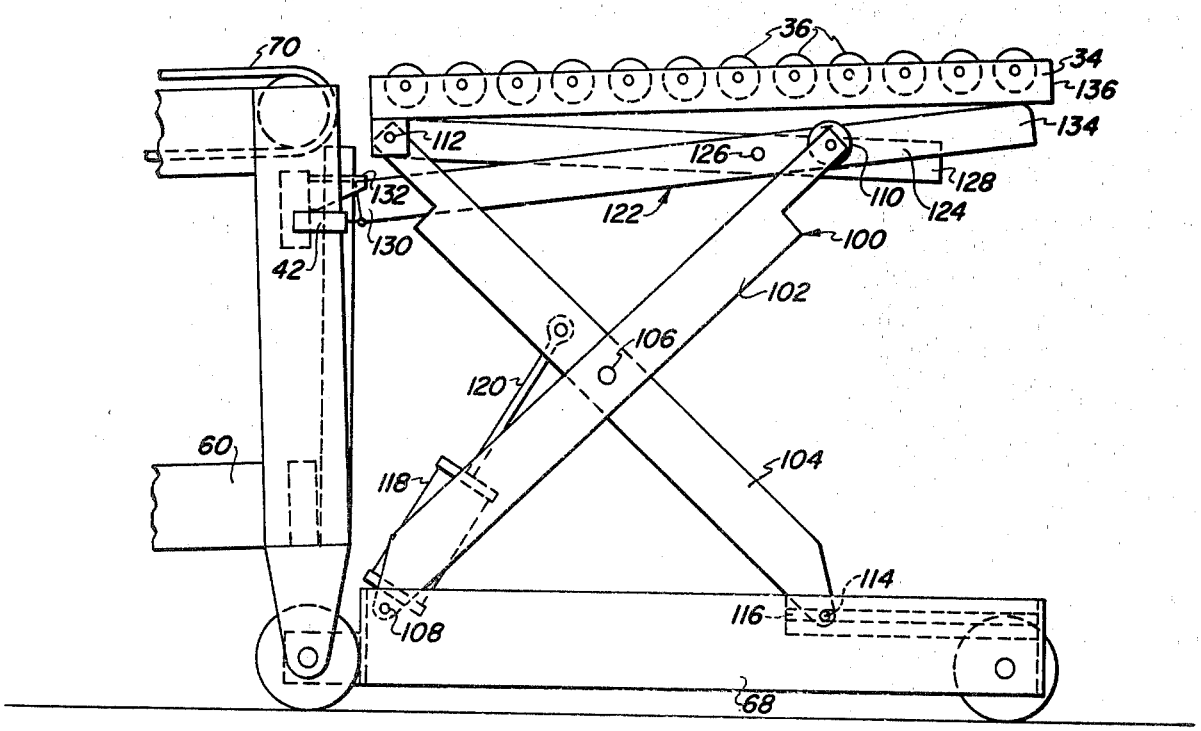
FIG. 9 is an enlarged fragmentary side elevational view similar to FIG. 8, but with the component parts in another operating position.

Referring now to FIGS. 8 and 9, as well as to FIGS. 1 through 7, the elevator means for raising the platform 34 from the first level L toward the second level LL includes a lift or elevator 100 having a pair of first links 102 pivotally connected to a pair of second links 104 at 106. One end of each first link 102 is pivotally connected at 108 to sub-frame 68 while the other end of each link 102 carries a roller 110 which normally supports platform 34. Second links 104 are pivotally connected at 112 to platform 34 while the other end of each second link 104 carries a pin 114 which slides in a slot 116 in the sub-frame 68. A hydraulic cylinder 118 is carried by the sub-frame 68 and includes a drive rod 120 connected to second links 104 as shown.

Upon actuation of elevator 100 to raise the platform 34, hydraulic fluid is supplied, under pressure, to cylinder 118, thus extending drive rod 120 and raising platform 34, as seen in FIG. 8. When the platform arrives at the intermediate position, illustrated in phantom in FIG. 8, limit switch 42, carried by frame 60, is actuated and serves to stop the supply of fluid to cylinder 118, thereby causing the platform 34 to dwell at the intermediate level. The intermediate level is placed closely adjacent to the upper or second level LL so that the stack carried by platform 34 dwells very near to the level at which the stack will be transferred to the feed conveyor 44. In this manner, very little time is consumed between the exhaustion of a stack on the feed conveyor 44 and the transfer of a subsequent stack to the feed conveyor.

When the operator pushes push-button switch 50 to effect the transfer of a stack from the platform 34 to the feed conveyor 44, the push-button switch 50 overrides the limit switch 42 and hydraulic fluid, under pressure, is again supplied to cylinder 118, thereby actuating links 102 and 104 to further raise platform 34. The transfer means includes a transfer mechanism 122 having a lever 124 pivoted at 126 to an intermediate bar 128 which itself is pivotally connected to the platform 34 at 112. A first end 130 of lever 124 is juxtaposed with frame 60 and comes into abutment with a stop 132 affixed to the frame 60, thus causing the second end 134 of lever 124 to continue upwardly in a swinging movement to raise the rearward end 136 of platform 34 and tilt the platform forward, as seen in FIGS. 5 and 9, enabling the force of gravity to bias a stack from the platform 34 toward the feed conveyor 44. At the same time, the actuation of limit switch 52 again discontinues the supply of fluid to cylinder 118 to stop the elevator 100. When the transferred stack actuates sheet sensing switch 54, hydraulic fluid is exhausted from cylinder 118 and the elevator 100 returns the platform 34 to the lower or first level L.

Turning now to FIGS. 10 through 14, as well as to FIGS. 1 through 7, the shingled arrangement of sheets 22 in shingled stream 28 is accomplished by feeding sheets from the bottom of a stack located at the stripper means in a forward direction so that the sheets pass through gate 46 of the stripper means. As explained hereinabove, a stack is transferred from the platform 34 to the feed conveyor 44 which carries the stack to the gate 46. Once located at the gate 46, the stack comes to rest against the stop assembly 56 and is stabilized against backward toppling by angle 58 which establishes a forward tilt in the feed conveyor 44 and the stack thereon.

Stop assembly 56 includes upright members 140, which are a part of main frame 60 and extend upwardly generally perpendicular to the feed conveyor 44. A cross-member 142 extends between the upright members 140. A plurality of vertical guide rails 144 and a thin guide plate 146 serve to keep the stack intact as the stack rests against the stop assembly 56 while easing the downward progression of the sheets in the stack as the height of the stack decreases during the feed of sheets from the bottom of the stack.

The gate 46 includes a gate bar 150 mounted between the upright members 140 and juxtaposed with the forward or outfeed end 152 of the feed conveyor 44. A guide blade 153 constructed of a material having a relatively low coefficient of friction, such as an ultra-high molecular weight synthetic resin, is affixed to the gate bar 150 and follows a curved contour which facilitates the feeding of sheets beneath the gate bar 150. An opening 154 between the guide blade 153 on gate bar 150 and the conveyor belts 70 of feed conveyor 44 enables the lowermost sheets of the stack to pass through the gate 46. The vertical size of the opening 154 regulates the number of sheets which can pass through the gate at any given instant and establishes the appropriate shingled arrangement.

Figure 10:
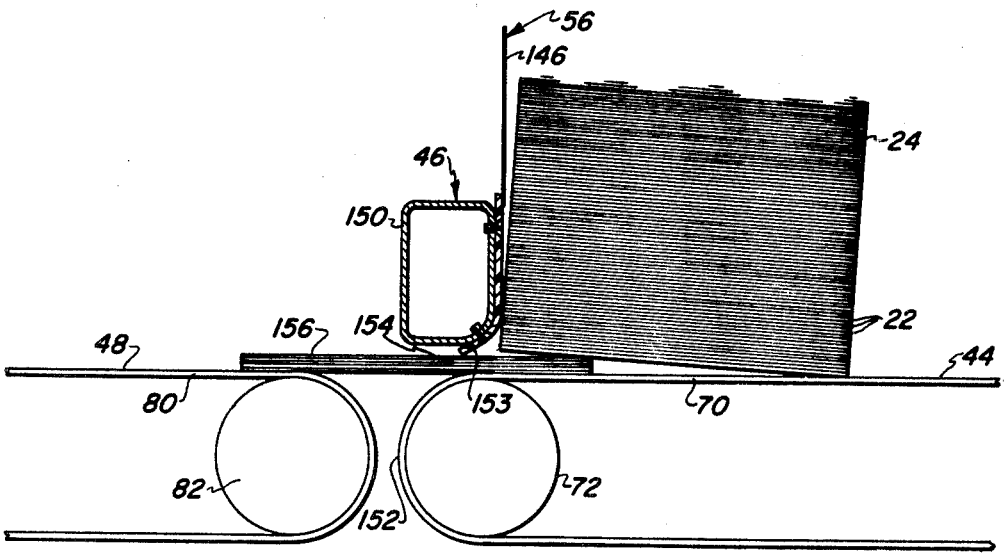
FIG. 10 is a partially diagrammatic fragmentary side elevational view illustrating a possible operating condition.

It has been found that if the opening 154 is set to approximately the thickness of each sheet in a stack, the sheets will pass through the gate in sequence without becoming shingled. If the opening 154 is set larger, i.e., several sheet thicknesses, there is a tendency for a clump to form among the initial sheets fed from the bottom of the stack. Thus, as illustrated in FIG. 10, gate bar 150 is raised above conveyor belts 70 of feed conveyor 44 a distance great enough to set opening 154 for the passage of several sheets and the initial sheets 22A have been advanced in a clump 156 from the bottom of the stack 24. Not only is the clump undesirable from the standpoint of passing unshingled sheets to the delivery conveyor 48, but the sudden advancement of a relatively thick clump 156 causes a backward tilt in stack 24 which can upset the stack, particularly where the stack is narrow in the front-to-back dimension. Hence, the condition shown in FIG. 10 is undesirable and is to be avoided.

In order to avoid the condition illustrated in FIG. 10, the gate bar 150 is mounted for automatic adjustment between a first position for the initial feed of sheets from each subsequent stack and a second position where the gate bar is placed during the continued advancement of sheets in shingled arrangement. Such automatic adjustment is attained by the mechanism best illustrated in FIG. 11 wherein it can be seen that gate 150 extends horizontally between upright members 140 and includes a projection 160 at each end of the gate bar 150, each projection being placed within a channel 162 in a corresponding upright member 140. Gate bar 150 is free to move vertically upwardly and downwardly within the limits of travel of the projections 160 within the channels 162 and is suspended above the conveyor belts 70 of feed conveyor 44 by lead screws 164 threaded through followers 166 affixed to the gate bar 150 and journalled for rotation in brackets 168 carried by upright members 140. A drive motor 170 is carried upon a mount 172 secured to an upright member 140 and is coupled to a drive shaft 174 extending between the upright members 140. The drive shaft 174 operates a pair of right angle drive units 176 which are coupled to the lead screws 164 such that upon actuation of the drive motor 170 in one direction or the other, the lead screws 164 will be rotated to raise or lower the gate bar 150. Upper and lower limit switches 180 and 182 determine the upper and lower positions of the gate bar 150, as follows.

Figure 11:
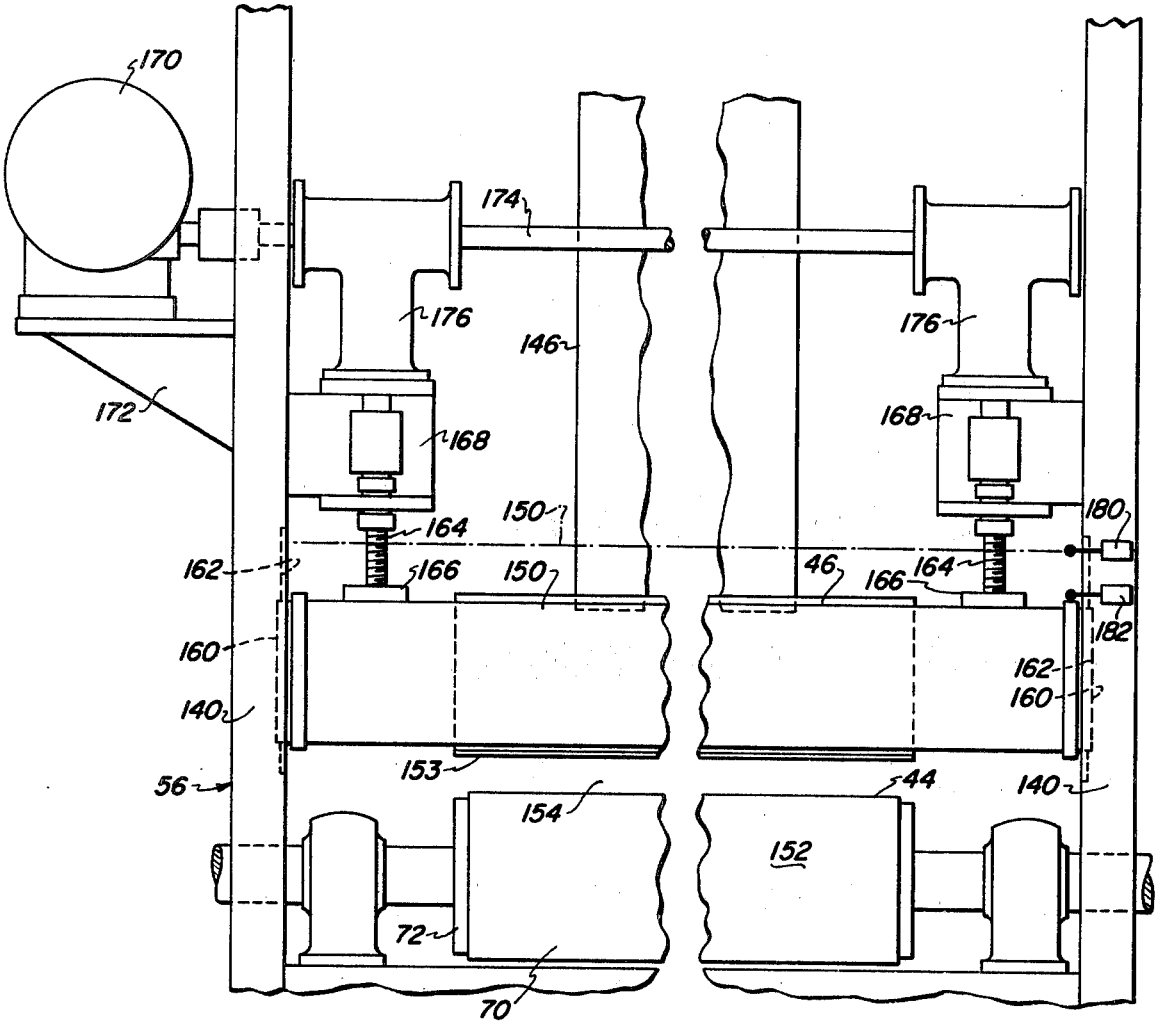
FIG. 11 is an enlarged fragmentary end elevational view illustrating further component parts of the apparatus.
Figure 12:
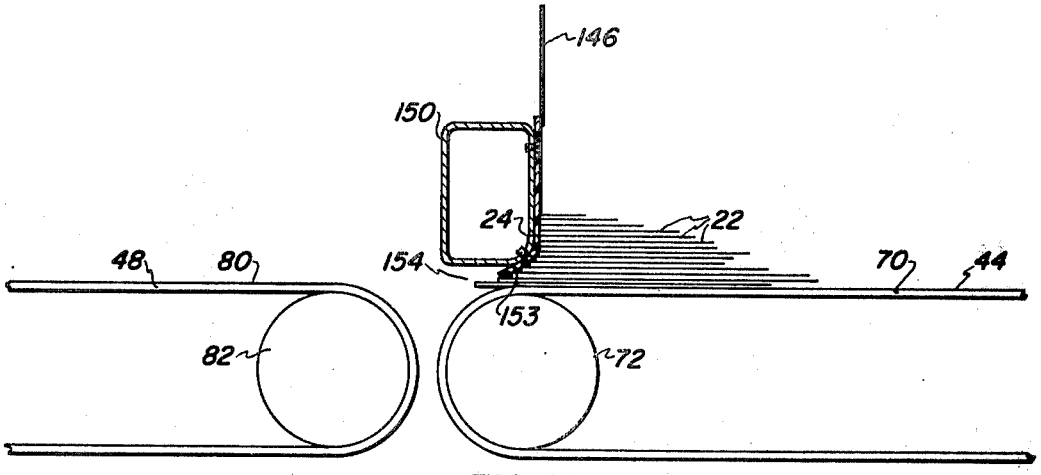
FIGS. 12 through 14 are partially diagrammatic fragmentary side elevational views illustrating a preferred sequence of operation.
Figure 13:
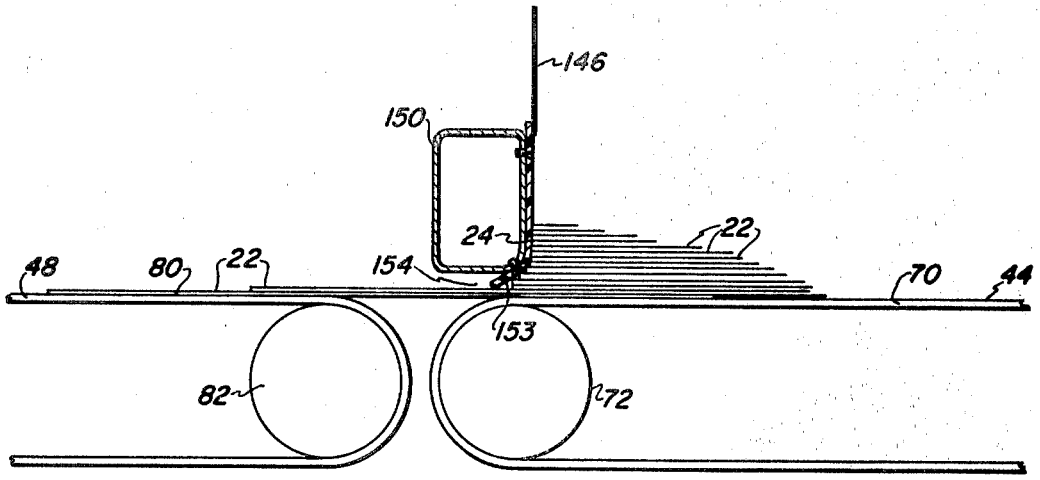
Figure 14:
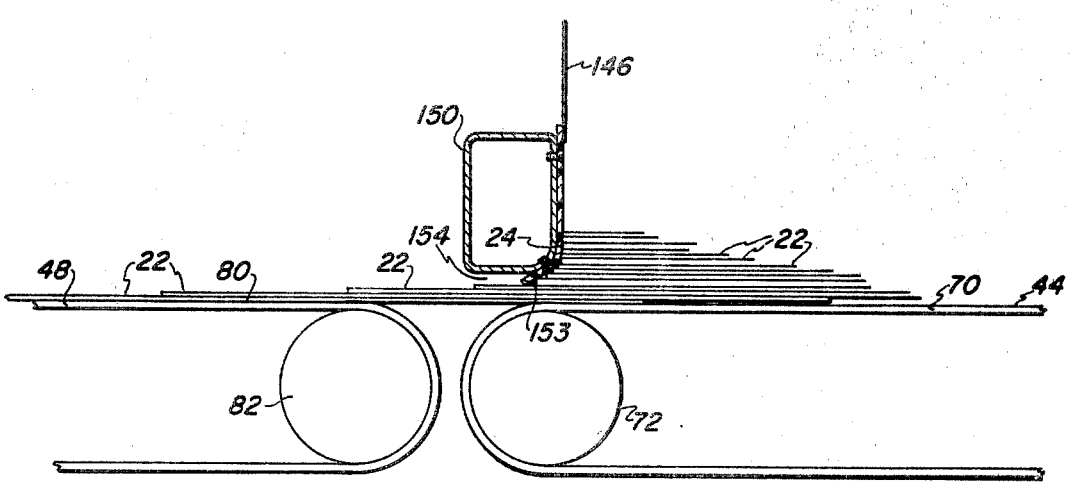

Referring now to FIGS. 12 through 14, as well as to FIG. 11, and the earlier description in connection with FIGS. 1 through 5, when it is determined by sheet sensing switch 54 that the last sheet 22L has passed beyond gate 46, drive motor 170 is actuated, in response to switch 54, to rotate the lead screws 164 and move the gate bar downwardly until both limit switches 180 and 182 open to indicate that the gate bar 150 has reached a lower or first position, as illustrated in FIGS. 11 and 12. At the lower position of gate bar 150, the opening 154 is only large enough to pass a few sheets 22 from the bottom of a stack 24 and cannot pass a clump, such as clump 156 shown in FIG. 10. Upon placement of a stack 24 in position for feeding sheets from the bottom of the stack, that is, against the stop assembly 56, sheet sensing switch 54 will be actuated by the sheets of the stack and the feed conveyor 44 will start to feed initial sheets from the bottom of the stack, as seen in FIG. 12.

At the same time, drive motor 170 will be actuated in the appropriate direction to begin moving gate bar 150 upwardly, thereby enabling the shingling process to begin, as seen in FIG. 13. Upward movement of the gate bar 150 will continue until the upper or second position of gate bar 150 is reached, as shown in FIG. 14, and in phantom in FIG. 11, and both limit switches 180 and 182 are closed to discontinue actuation of the drive motor 170. The sheets 22 will continue to be advanced beneath gate bar 150 in shingled arrangement to establish the shingled stream 28 along the delivery conveyor 48. Upon exhaustion of the stack, the gate bar 150 will be lowered again until a subsequent stack is advanced to the gate bar and the entire shingling process will be repeated. In this manner, deleterious clumping is eliminated and the desired shingled arrangement is attained.

Figure 15:
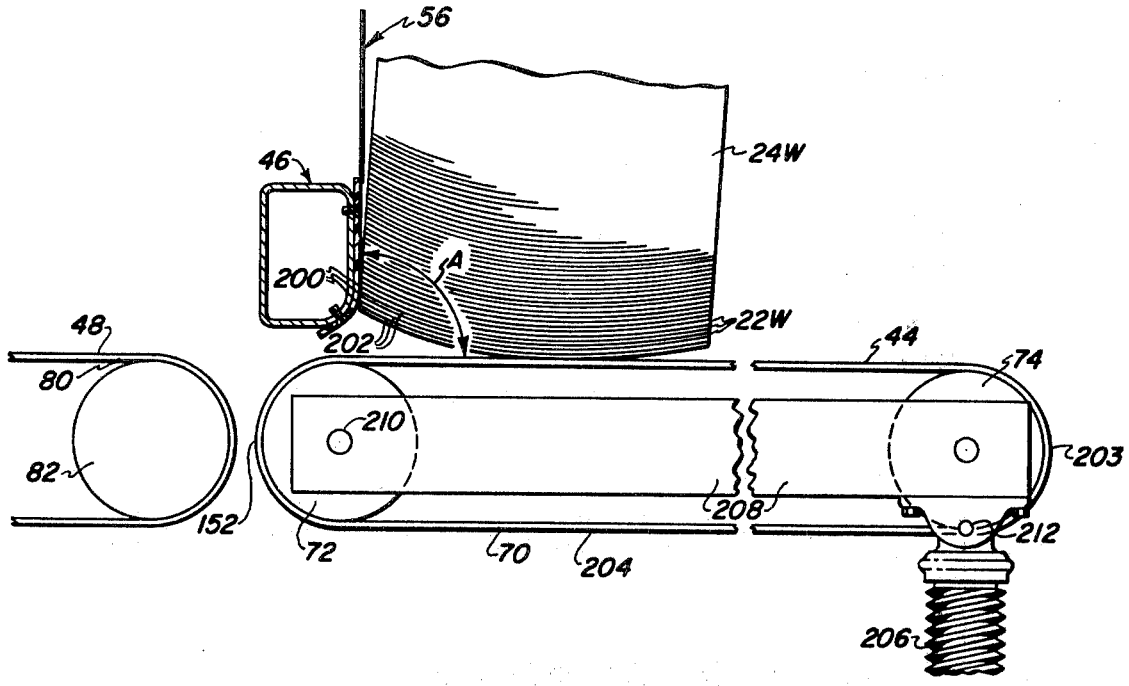
FIG. 15 is a partially diagrammatic fragmentary side elevational view illustrating a further feature of the apparatus.
Figure 16:
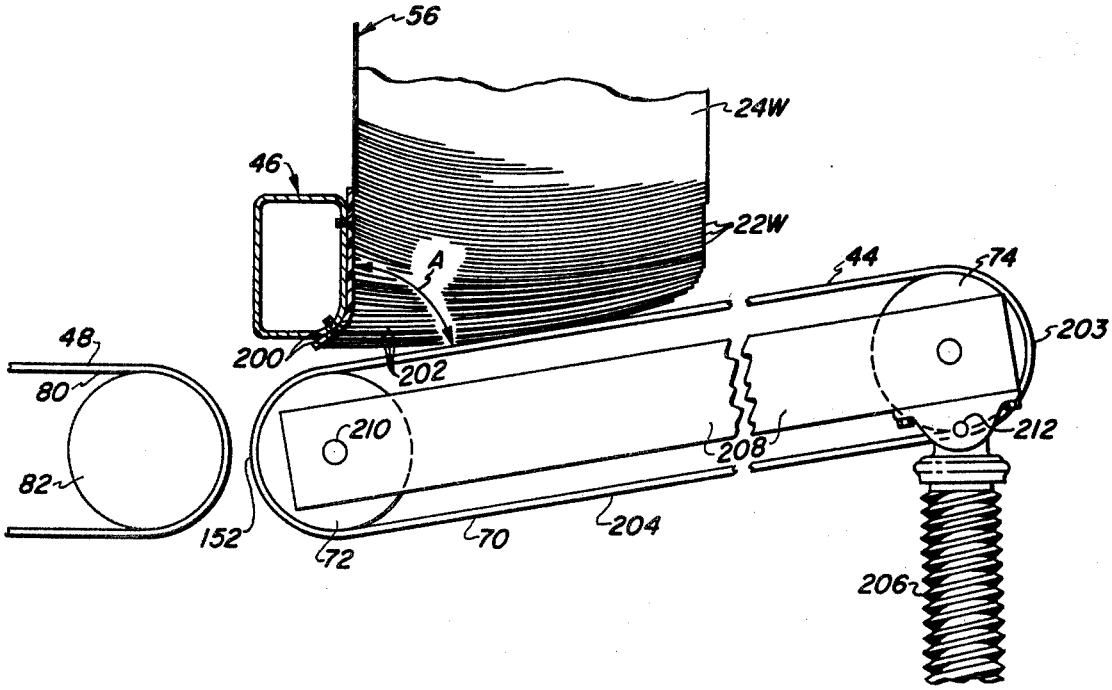
FIG. 16 is a view similar to FIG. 15, but with component parts in a different operating position.

Turning now to FIGS. 15 and 16, in many instances the sheets 22 of a stack 24 will be warped, as seen in stack 24W where sheets 22W are warped. The warped configuration of the lowermost of sheets 22W tends to raise the leading edge 200 of lowermost sheets 202 so that leading edge 200 is butted against gate 46, as illustrated in FIG. 15, thereby precluding the advancement of sheets 202, and subsequent sheets 22W, from the stack 24W.

In order to effect the desired advancement of lowermost sheet 202, and subsequent sheets 22W, from the bottom of stack 24W, a warp-compensating means is provided for changing the angle of feed conveyor 44 relative to gate 46 and stop assembly 56 so that the lowermost of sheets 22W will be shifted to enable the leading edges of the sheets to pass beneath the gate 46. As best seen in FIGS. 6 and 7, as well as in FIGS. 15 and 16, feed conveyor 44 includes an infeed end 203 as well as the outfeed end 152 and the central portion 204 of feed conveyor 44 is provided with lifting means in the form of screw jacks 206 at each end of idler roll 74 of the central portion 204. The idler roll 74 of central portion 204 is carried by a sub-frame 208 pivoted to the main frame 60 at 210 and the screw jacks 206 are pinned to the sub-frame 208 at 212. Upon actuation of the screw jacks 206 to raise the idler roll 74 of central portion 204, as seen in FIG. 16, the angle A between conveyor belt 70 of central portion 204 and the gate 46 and stop assembly 56 is changed, i.e., is made smaller by virtue of the upward tilt of conveyor belt 70, causing the stack 22W to shift and bringing the leading edges 200 downwardly, thereby enabling advancement of the lowermost sheet 202 beneath the gate in response to operation of the feed conveyor 44.

Screw jacks 206 extend between the sub-frame 208 and the main frame 60, to which the screw jacks are pinned at 214. A motor 216 actuates each screw jack 206 to raise and lower the idler roll 74 of central portion 204 between the positions illustrated in FIGS. 15 and 16. Initially, the idler roll 74 and central portion 204 are in the rest position shown in FIG. 15 (and in full lines in FIG. 7) so as to receive an oncoming stack upon the feed conveyor 44. Once the oncoming stack is in place against the gate 46 and stop assembly 56, the operator can determine if it is necessary to raise the central portion 204 of the feed conveyor 44 in order to initiate advancement of the sheets in the stack. If it is determined that the central portion must be raised, the operator presses a push-button 218 to activate the motors 216 to actuate screw jacks 206 and raise the central idler roll 74 and central portion 204 to the position shown in FIG. 16 (and in phantom in FIG. 7). Upon completion of the advancement of the sheets of the stack 24W, the motors 216 are again activated, preferably automatically in response to the advancement of the last sheet in stack 24W, to lower and return the central idler roll 74 and central portion 204 to the rest position shown in FIG. 15. Thus, apparatus 20 is able to handle stacks of warped sheets where necessary.

It is to be understood that the above detailed description of preferred embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A case blank sheet feeder for receiving a stack of case blank sheets from a source of supply and delivering the sheets in a forward direction from the bottom of the stack in shingled arrangement for further processing, said case blank sheet feeder comprising:

receiving means located at a first level for receiving the stack of case blank sheets from the source;

feed means located at a second level above the first level for advancing the sheets in the forward direction from the bottom of each stack to feed the sheets from the sheet feeder:

elevator means for raising the receiving means from the first level toward the second level, the elevator means including an elevator for moving the receiving means in a vertical direction generally perpendicular to the forward direction, dwell means for stopping the receiving means at a further level intermediate the first level and the second level, and override means for deactivating the dwell means to enable the elevator means to raise the receiving means to the second level;

stripper means associated with the feed means for controlling the feeding of the sheets from the sheet feeder so as to feed a shingled stream in the forward direction from the bottom of the stack of sheets; and stabilizing means for precluding toppling of the stack in a backward direction during feeding of the sheets from the bottom of the stack.

2. The invention of claim 1 wherein the further level is closely adjacent to the second level.

3. The invention of claim 2 wherein the feed means operates to deliver sheets in a forward direction while the elevator means raises the receiving means from the first level to the further level.

4. A case blank sheet feeder for receiving a stack of case blank sheets from a source of supply and delivering the sheets in a forward direction from the bottom of the stack in shingled arrangement for further processing, said case blank sheet feeder comprising:

receiving means located at a first level for receiving the stack of case blank sheets from the source;

feed means located at a second level above the first level for advancing the sheets in the forward direction from the bottom of each stack to feed the sheets from the sheet feeder;

elevator means for raising the receiving means from the first level toward the second level;

stripper means associated with the feed means for controlling the feeding of the sheets from the sheet feeder so as to feed a shingled stream in the forward direction from the bottom of the stack of sheets, the stripper means including a gate movable upwardly and downwardly relative to the feed means for regulating the number of sheets able to pass beneath the gate in response to the actuation of the feed means;

means for moving the gate downward to a first position located toward the feed means such that the gate will be at the first position upon advancing the initial sheet from the bottom of the stack at the feed means, and upward to a second position located above the first position such that the gate will be at the second position during the continued advancement of sheets from that stack; and stabilizing means for precluding toppling of the stack in a backward direction during feeding of the sheets from the bottom of the stack.

5. A case blank sheet feeder for receiving a stack of case blank sheets from a source of supply and delivering the sheets in a forward direction from the bottom of the stack in shingled arrangement for further processing, said case blank sheet feeder comprising:

receiving meeans located at a first level for receiving the stack of case blank sheets from the source;

feed means located at a second level above the first level for advancing the sheets in the forward direction from the bottom of each stack to feed the sheets from the sheet feeder, the feed means including a feed conveyor having feed conveyor belts for advancing the sheets longitudinally in the forward direction;

elevator means for raising the receiving means from the first level toward the second level;

stripper means associated with the feed means for controlling the feeding of the sheets from the sheet feeder so as to feed a shingled stream in the forward direction from the bottom of the stack of sheets;

stabilizing means for precluding toppling of the stack in a backward direction during feeding of the sheets from the bottom of the stack; and warp-compensating means for selectively changing the angle between at least a portion of the feed conveyor and the stripper means to shift the location of the leading edge of the lowermost sheet in the stack relative to the stripper means and facilitate advancement of the lowermost sheet through the stripper means.

6. The invention of claim 5 wherein the feed conveyor includes an infeed end and an outfeed end, the outfeed end being adjacent the stripper means and the infeed end being in position to receive a stack from the source of supply, the warp-compensating means including lifting means for selectively raising the infeed end of said portion of the feed conveyor relative to the outfeed end thereof.

7. A case blank sheet feeder for receiving a stack of case blank sheets from a source of supply and delivering the sheets in a forward direction from the bottom of the stack, one sheet at a time in shingled arrangement, for further processing, said case blank sheet feeder comprising:

receiving means located at a first level for receiving the stack of case blank sheets from the source;

feed means located at a second level about the first level for delivering the sheets in the forward direction from the bottom of each stack to feed the sheets from the sheet feeder, the feed means including a feed conveyor having a rearward end adjacent the receiving means, a forward end, and feed conveyor belts for advancing the sheets longitudinally toward the forward end;

elevator means for raising the receiving means from the first level toward the second level; and stripper means located at the forward end of the feed conveyor for controlling the feeding of the sheets from the sheet feeder so as to feed a shingled stream in the forward direction from the bottom of the stack of sheets;

the feed conveyor terminating at the stripper means, and the feed means including a delivery conveyor extending in a forward longitudinal direction from the stripper means, the delivery conveyor having delivery conveyor belts mounted for movement laterally to selected lateral locations relative to the feed conveyor belts for selected adjustment to different lateral widths so as to accommodate sheets of different lateral widths while enabling ease of access to the sheets on the delivery conveyor.

8. The invention of claim 7 wherein the total area of the feed conveyor belts is relatively large in comparison to the total area of the delivery conveyor belts to enable greater frictional gripping forces to be exerted upon the advanced sheets by the feed conveyor belts, while enabling the lateral adjustment of the delivery conveyor belts.

9. A case blank sheet feeder for receiving a stack of case blank sheets from a source of supply and delivering the sheets in a forward direction from the bottom of the stack, one sheet at a time in shingled arrangement, for further processing, said case blank sheet feeder comprising:

receiving means located at a first level for receiving the stack of case blank sheets from the source;

feed means located at a second level above the first level for delivering the sheets in the forward direction from the bottom of each stack to feed the sheets from the sheet feeder, the feed means including a feed conveyor having a rearward end adjacent the receiving means, a forward end, and a feed conveyor having feed conveyor belts for advancing the sheets longitudinally toward the forward end;

elevator means for raising the receiving means from the first level toward the second level;

stripper means located at the forward end of the feed conveyor for controlling the feeding of the sheets from the sheet feeder so as to feed a shingled stream in the forward direction from the bottom of the stack of sheets; and warp-compensating means for selectively changing the angle between at least a portion of the feed conveyor and the stripper means to shift the location of the leading edge of the lowermost sheet in the stack relative to the stripper means and facilitate advancement of the lowermost sheet through the stripper means.

10. The invention of claim 9 wherein the feed conveyor includes an infeed end and an outfeed end, the outfeed end being adjacent the stripper means and the infeed end being in position to receive a stack from the source of supply, the warp-compensating means including lifting means for selectively raising the infeed end of said portion of the feed conveyor relative to the outfeed end thereof.

11. A case blank sheet feeder for receiving a stack of case blank sheets from a source of supply and delivering the sheets in a forward direction from the bottom of the stack, one sheet at a time in shingled arrangement, for further processing, said case blank sheet feeder comprising:

receiving means located at a first level for receiving the stack of case blank sheets from the source;

feed means located at a second level above the first level for delivering the sheets in the forward direction from the bottom of each stack to feed the sheets from the sheet feeder, the feed means including a feed conveyor having a rearward end adjacent the receiving means, and a forward end;

elevator means for raising the receiving means from the first level toward the second level, the elevator means including an elevator for moving the receiving means in a vertical direction generally perpendicular to the forward direction, dwell means for stopping the receiving means at a further level intermediate the first level and the second level, and override means for deactivating the dwell means to enable the elevator means to raise the receiving means to the second level; and stripper means located at the forward end of the feed conveyor for controlling the feeding of the sheets from the sheet feeder so as to feed a shingled stream in the forward direction from the bottom of the stack of sheets.

12. The invention of claim 11 wherein the further level is closely adjacent to the second level.

13. The invention of claim 12 wherein the feed means operates to deliver sheets in a forward direction while the elevator means raises the receiving means from the first level to the further level.

14. A case blank sheet feeder for receiving a stack of case blank sheets from a source of supply and delivering the sheets in a forward direction from the bottom of the stack, one sheet at a time in shingled arrangement, for further processing, said case blank sheet feeder comprising:

receiving means located at a first level for receiving the stack of case blank sheets from the source;

feed means located at a second level above the first level for delivering the sheets in the forward direction from the bottom of each stack to feed the sheets from the sheet feeder, the feed means including a feed conveyor having a rearward end adjacent the receiving means, and a forward end;

elevator means for raising the receiving means from the first level toward the second level; and stripper means located at the forward end of the feed conveyor for controlling the feeding of the sheets from the sheet feeder so as to feed a shingled stream in the forward direction from the bottom of the stack of sheets, the stripper means including a gate movable upwardly and downwardly relative to the feed means for regulating the number of sheets able to pass beneath the gate in response to the actuation of the feed means; and means for moving the gate downward to a first position located toward the feed means such that the gate will be at the first position upon advancing the initial sheet from the bottom of the stack at the feed means, and upward to a second position located above the first position such that the gate will be at the second position during the continued advancement of sheets from that stack.

* * * * *